US007618351B2

(12) United States Patent
Kwon et al.

(10) Patent No.: US 7,618,351 B2
(45) Date of Patent: Nov. 17, 2009

(54) PEDAL EXERCISE MACHINE HAVING ARC TRAJECTORY

(75) Inventors: Taeg Joon Kwon, Seoul (KR); Sang Young Choi, Goyang (KR); Eung Won Kim, Bucheon (KR); Sang Seo Han, Incheon (KR); Sang Jun Han, Seoul (KR); Gi Hong Kim, Seoul (KR)

(73) Assignee: Motus Co., Ltd. (KR)

( * ) Notice: Subject to any disclaimer, the term of this patent is extended or adjusted under 35 U.S.C. 154(b) by 0 days.

(21) Appl. No.: 12/266,389

(22) Filed: Nov. 6, 2008

(65) Prior Publication Data

US 2009/0209394 A1 Aug. 20, 2009

(30) Foreign Application Priority Data

Feb. 18, 2008 (KR) ..... 10 2008 0014594
Feb. 18, 2008 (KR) ..... 10-831240

(51) Int. Cl.
*A63B 22/04* (2006.01)

(52) U.S. Cl. ..... 482/52; 482/57

(58) Field of Classification Search ..... 482/51–53, 482/57, 70, 71, 62; 434/247, 255
See application file for complete search history.

(56) References Cited

U.S. PATENT DOCUMENTS 4,915,374 A * 4/1990 Watkins ..... 482/57
4,949,993 A * 8/1990 Stark et al. ..... 482/52
5,040,786 A * 8/1991 Jou ..... 482/128
5,207,621 A * 5/1993 Koch et al. ..... 482/53
5,279,529 A 1/1994 Eschenbach
5,336,142 A * 8/1994 Dalebout et al. ..... 482/52
5,336,143 A * 8/1994 Wu ..... 482/52
5,401,226 A * 3/1995 Stearns ..... 482/53
5,419,748 A * 5/1995 Snyderman et al. ..... 482/52
5,499,956 A * 3/1996 Habing et al. ..... 482/52
5,503,607 A * 4/1996 Lo ..... 482/52
5,577,985 A * 11/1996 Miller ..... 482/52
5,741,205 A * 4/1998 Doll et al. ..... 482/52
5,766,113 A * 6/1998 Rodgers, Jr. ..... 482/52
5,810,696 A * 9/1998 Webb ..... 482/52

(Continued)

FOREIGN PATENT DOCUMENTS

KR 20-2000-000468 1/2000

(Continued)

*Primary Examiner*—Loan H Thanh
*Assistant Examiner*—Daniel F Roland
(74) *Attorney, Agent, or Firm*—Booth Udall, PLC

(57) ABSTRACT

A pedal exercise machine includes an arc trajectory with a length adjustment for adjusting the lengths of pedal trajectories and arm levers, an angle adjustment for adjusting the position of the pedal trajectory, and a displacement mechanism for adjusting the pedals' angles relative to the ground. The pedal exercise machine includes a base, a front frame and a center frame, coupled together, a pair of pedals, a pair of pedal links, and a pair of subsidiary pedal links, which are coupled to the respective pedals by shafts different from shafts which the respective pedal links are coupled to the corresponding pedals. The pedal exercise machine further includes a resistance pulley, a crank shaft, and a pair of crank link units. Each crank link unit has the angle adjustment mechanism configured to adjust the angle between the corresponding pedal link and the corresponding crank link unit.

10 Claims, 10 Drawing Sheets

U.S. PATENT DOCUMENTS

| | | | | |
|---|---|---|---|---|
| 5,921,894 | A | 7/1999 | Eschenbach | |
| 5,924,963 | A * | 7/1999 | Maresh et al. | 482/57 |
| 5,957,814 | A * | 9/1999 | Eschenbach | 482/51 |
| 5,961,423 | A * | 10/1999 | Sellers | 482/57 |
| 6,024,676 | A | 2/2000 | Eschenbach | |
| 6,045,487 | A * | 4/2000 | Miller | 482/52 |
| 6,077,198 | A * | 6/2000 | Eschenbach | 482/52 |
| 6,090,013 | A * | 7/2000 | Eschenbach | 482/52 |
| 6,334,836 | B1 * | 1/2002 | Segasby | 482/4 |
| 6,409,632 | B1 * | 6/2002 | Eschenbach | 482/52 |
| 6,422,976 | B1 * | 7/2002 | Eschenbach | 482/52 |
| 6,422,977 | B1 * | 7/2002 | Eschenbach | 482/52 |
| 6,436,007 | B1 * | 8/2002 | Eschenbach | 482/52 |
| 6,589,139 | B1 * | 7/2003 | Butterworth | 482/57 |
| 6,689,021 | B2 | 2/2004 | Stevens | |
| 6,695,749 | B2 * | 2/2004 | Kuo | 482/53 |
| 6,855,094 | B1 * | 2/2005 | Maresh | 482/52 |
| 6,949,054 | B1 * | 9/2005 | Stearns et al. | 482/52 |
| 7,025,710 | B2 | 4/2006 | Corbalis et al. | |
| 7,037,242 | B2 | 5/2006 | Lo et al. | |
| 7,204,788 | B2 * | 4/2007 | Andrews | 482/57 |
| 7,261,675 | B2 * | 8/2007 | Kuo | 482/52 |
| 7,267,638 | B2 | 9/2007 | Wang | |
| 7,485,072 | B2 * | 2/2009 | Chuang et al. | 482/52 |
| 2005/0124466 | A1 * | 6/2005 | Rodgers, Jr. | 482/52 |
| 2005/0148438 | A1 * | 7/2005 | Carlsen et al. | 482/52 |
| 2005/0239609 | A1 * | 10/2005 | Chen | 482/57 |
| 2006/0003871 | A1 * | 1/2006 | Houghton et al. | 482/57 |
| 2006/0264301 | A1 * | 11/2006 | Kuo | 482/52 |
| 2008/0242516 | A1 * | 10/2008 | Lu et al. | 482/52 |
| 2009/0011904 | A1 * | 1/2009 | Chuang et al. | 482/52 |

FOREIGN PATENT DOCUMENTS

| | | |
|---|---|---|
| KR | 20-027771 | 2/2002 |
| KR | 10-0499232 | 6/2005 |

* cited by examiner

[AM : 131a, 81, 133]

PEDAL EXERCISE MACHINE HAVING ARC TRAJECTORY

BACKGROUND OF THE INVENTION

1. Field of the Invention

The present invention relates generally to pedal exercise machines and, more particularly, to a pedal exercise machine having an arc trajectory which includes a length adjustment mechanism configured to adjust the sizes of trajectories of pedals and arm levers, an angle adjustment mechanism configured to adjust the position of the trajectory of the pedals, and a displacement mechanism configured to adjust the angle of the pedals relative to the ground in conjunction with the length adjustment mechanism, thus enabling a user to exercise desired parts of the body using the above mechanism, thereby obtaining various exercise effects, and, particularly, providing a pedal trajectory similar to a foot trajectory when climbing a slope or stairs.

2. Description of the Related Art

To date, exercise machines having various trajectories have been disclosed.

Representative examples of exercise machines having vertical (or slightly inclined) linear exercise trajectories were proposed in Korean Utility Model Laid-open Publication No. 20-2000-0000468 (publication date: Jan. 15, 2000), which was entitled "LOWER BODY EXERCISE MACHINE", and in Korean Utility Model Registration No. 20-0277771 (registration date: Feb. 28, 2002), which was entitled "ROCK CLIMBING EXERCISE MACHINE".

Furthermore, an elliptical exercise machine, which enables exercise along an asymmetrical elliptical trajectory, was proposed in Korean Patent Registration No. 10-0499232 (registration date: Jun. 24, 2005), which was entitled "ELLIPTICAL".

In addition, other elliptical exercise machines were proposed in U.S. Pat. No. 6,024,676 (COMPACT CROSS TRAINER EXERCISE APPARATUS), No. 6,689,021 (ELLIPTICAL TRAINER), No. 7,025,710 (ELLIPTICAL EXERCISE DEVICE AND ARM LINKAGE) and No. 7,267,638 (PACE-ADJUSTING MECHANISM OF AN ELLIPTICAL CROSS TRAINER).

As exercise machines having various exercise trajectories have been developed and improved, the applicant of the present invention proposes a further improved exercise machine, particularly, one having an exercise trajectory similar to that when a person climbs a slope or stairs.

In particular, the applicant of the present invention proposes a pedal exercise machine having an arc trajectory which is constructed such that trajectories of pedals and lever arms are adjustable, the positions of the trajectories of the pedals and lever arms are adjustable, and the angle of the pedals relative to the ground is adjustable, thus providing various exercise effects.

SUMMARY OF THE INVENTION

Accordingly, the present invention has been made keeping in mind the above problems occurring in the prior art, and an object of the present invention is to provide a pedal exercise machine having an arc trajectory which includes a length adjustment mechanism configured to increase or reduce the lengths of trajectories of pedals and arm levers to correspond to the height of a user and the length of the arms of the user.

Another object of the present invention is to provide a pedal exercise machine having an arc trajectory which includes an angle adjustment mechanism configured to adjust the position of the trajectory of the pedals, thus providing various exercise effects.

A further object of the present invention is to provide a pedal exercise machine having an arc trajectory which includes a displacement mechanism configured to adjust the angle of the pedals relative to the ground along with the length adjustment mechanism, so that the exercise posture of the user, in particular, the position of the ankles of the user, can be easily changed.

In order to accomplish the above objects, in an aspect, the present invention provides a pedal exercise machine having an arc trajectory, including: a base; a front frame and a center frame provided on the base, the front frame and the center frame being coupled to each other; a pair of pedals to move upwards and downwards in alternating directions; a pedal link for connecting each of the pedals to the base; a subsidiary pedal link for connecting each of the pedals to the center frame, the subsidiary pedal link being coupled to the pedal by a first shaft different from a second shaft, through which the corresponding pedal link is coupled to the corresponding pedal; a resistance pulley provided in the center frame; a crank shaft coupled to the resistance pulley, the crank shaft being provided with crank arms, each of which has length adjustment mechanism; and a crank link unit for connecting each of the pedal links to the corresponding crank arm of the crank shaft, the crank link unit having angle adjustment mechanism configured to adjust an angle between the corresponding pedal link and the corresponding crank link unit around a base-side shaft of the pedal link.

In another aspect, the present invention provides a pedal exercise machine having an arc trajectory, including: a base; a front frame and a center frame provided on the base, the front frame and the center frame being coupled to each other; a pair of pedals to move upwards and downwards in alternating directions; a pedal link for connecting each of the pedals to the base; a subsidiary pedal link for connecting each of the pedals to the center frame, the subsidiary pedal link being coupled to the pedal by the first shaft different from the second shaft, through which the corresponding pedal link is coupled to the corresponding pedal; a resistance pulley provided in the center frame; a crank shaft coupled to the resistance pulley, the crank shaft being provided with crank arms, each of which has length adjustment mechanism; and a crank link unit for connecting each of the pedal links to the corresponding crank arm of the crank shaft, the crank link unit being coupled to the corresponding pedal link around a base-side shaft of the pedal link at a predetermined angle.

In a further aspect, the present invention provides a pedal exercise machine having an arc trajectory, including: a base; a front frame and a center frame provided on the base, the front frame and the center frame being coupled to each other; a pair of pedals to move upwards and downwards in alternating directions; a pedal link for connecting each of the pedals to the base; a subsidiary pedal link for connecting each of the pedals to the center frame, the subsidiary pedal link being coupled to the pedal by the first shaft different from the second shaft through which the corresponding pedal link is coupled to the corresponding pedal, the subsidiary pedal link having a displacement mechanism configured to displace relative to the corresponding pedal; a resistance pulley provided in the center frame; a crank shaft coupled to the resistance pulley, the crank shaft being provided with a crank arm; and a crank link unit for connecting each of the pedal links to the corresponding crank arm of the crank shaft, the crank link unit being coupled to the corresponding pedal link around a base-side shaft of the pedal link at a predetermined angle.

The crank link unit may include: a first crank link coupled to the corresponding pedal link at a predetermined angle; and a second crank link coupled at respective opposite ends thereof to the first crank link and the corresponding crank arm.

The pedal exercise machine may further include: a pair of arm levers coupled to the front frame, the arm levers being rotatable with respect to the front frame in alternating directions; and a lever link unit for connecting each of the arm levers to the corresponding pedal, the lever link unit being coupled to the pedal by the shaft that couples the corresponding pedal link to the corresponding pedal.

The lever link unit may include a first lever link coupled to the corresponding arm lever; and a second lever link coupled at respective opposite ends thereof to the first lever link and the corresponding pedal.

The displacement mechanism may be constructed such that angles of the pedals relative to a ground vary depending on positions, at which the subsidiary pedal links are coupled to the center frame, the pedals, or both the center frame and the pedals.

The displacement mechanism may be constructed such that the subsidiary pedal link comprises two separate bodies coupled to each other so as to be adjustable in length.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 1:
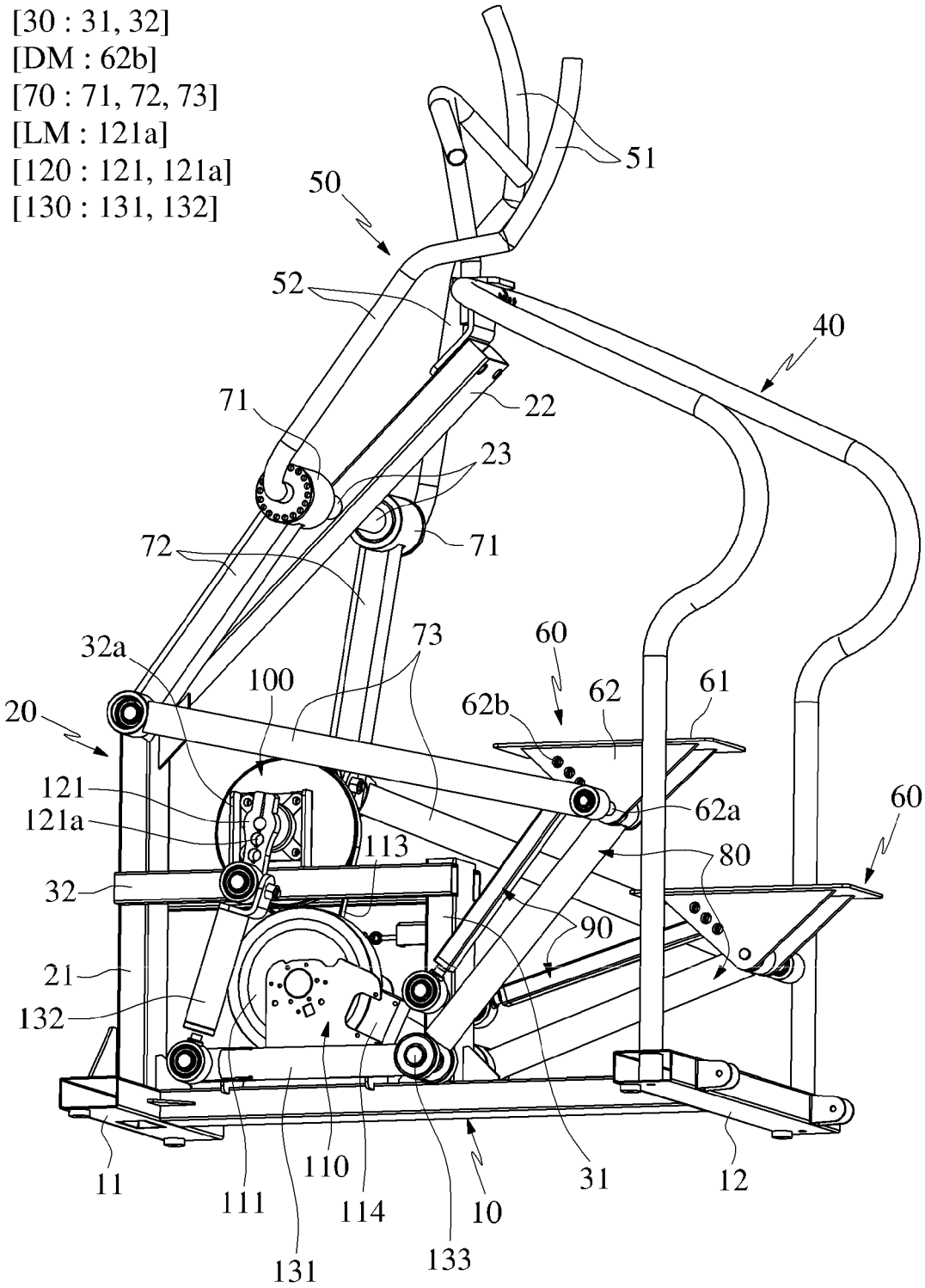
FIG. 1 is a perspective view showing a pedal exercise machine having an arc trajectory, according to an embodiment of the present invention.
Figure 2:
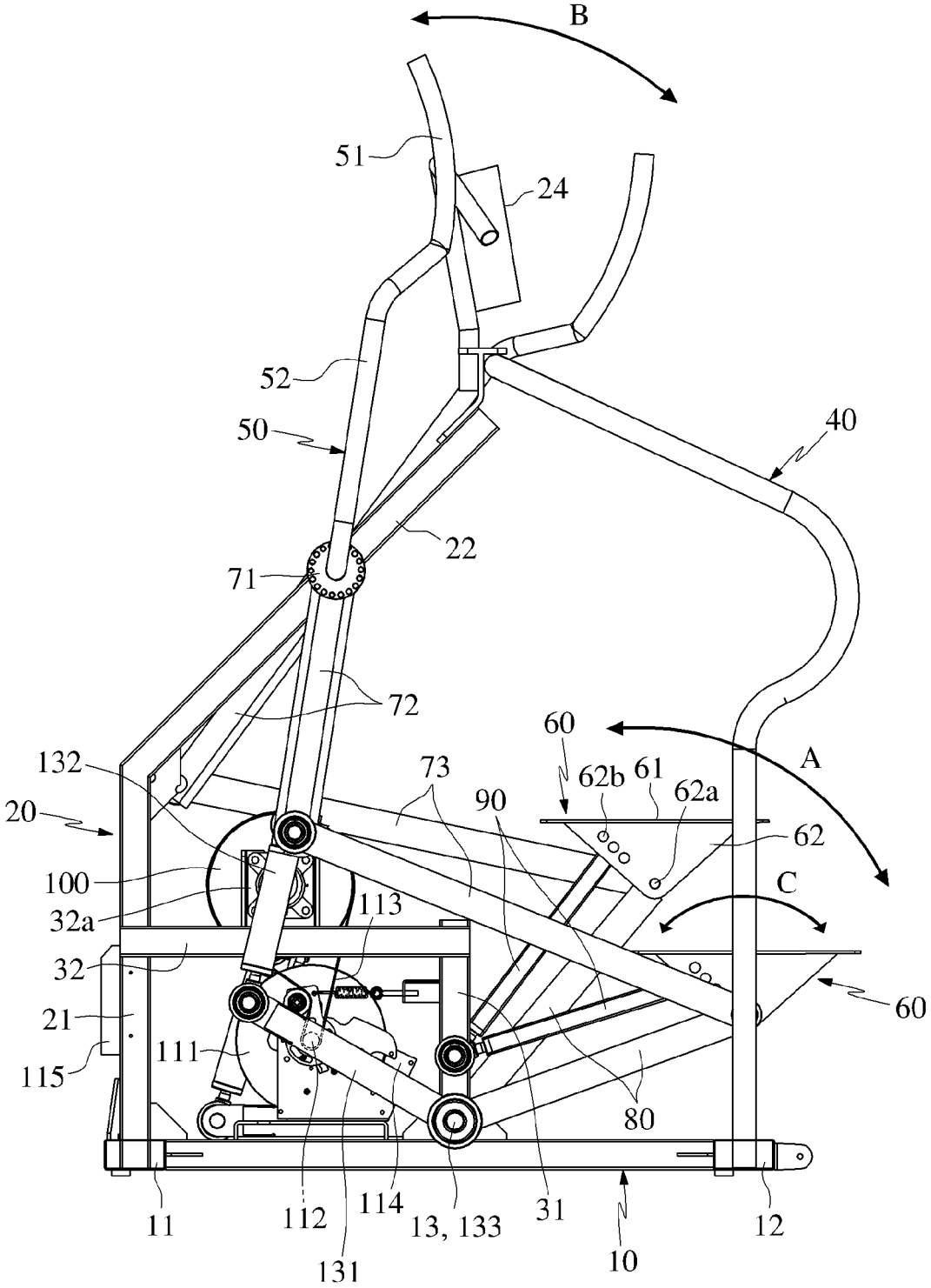
FIG. 2 is a side view showing the pedal exercise machine according to the present invention.
Figure 3:
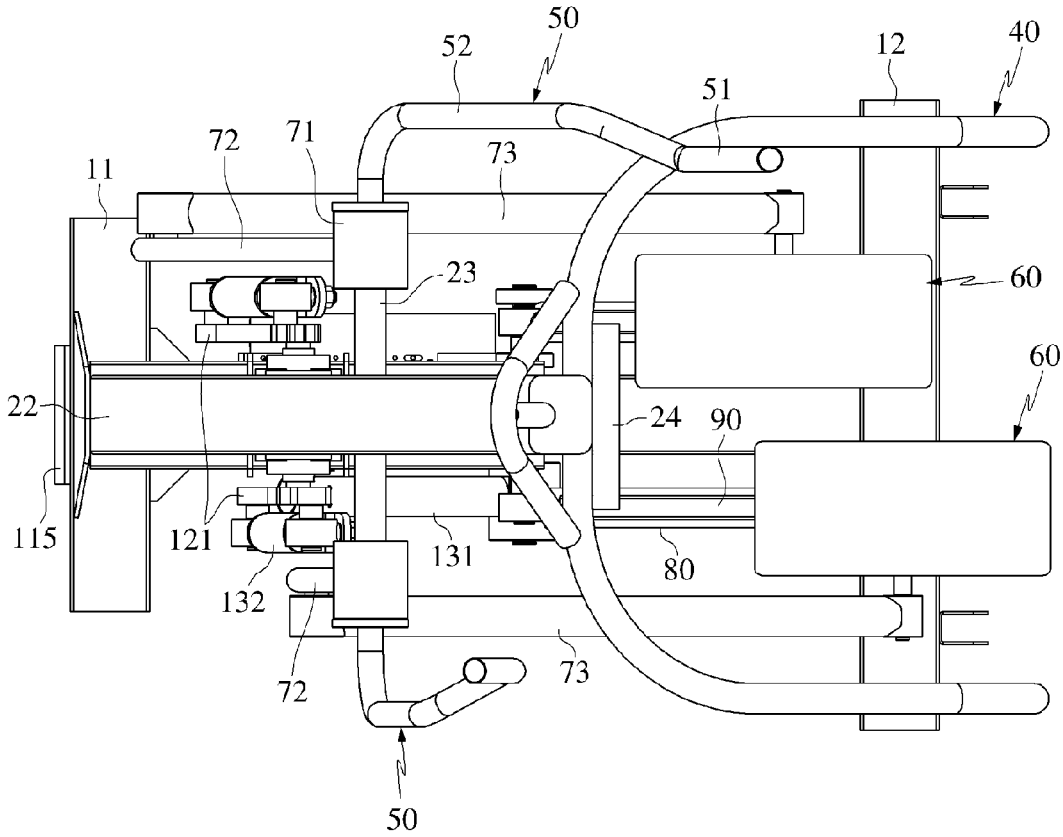
FIG. 3 is a plan view showing the pedal exercise machine according to the present invention.
Figure 4:
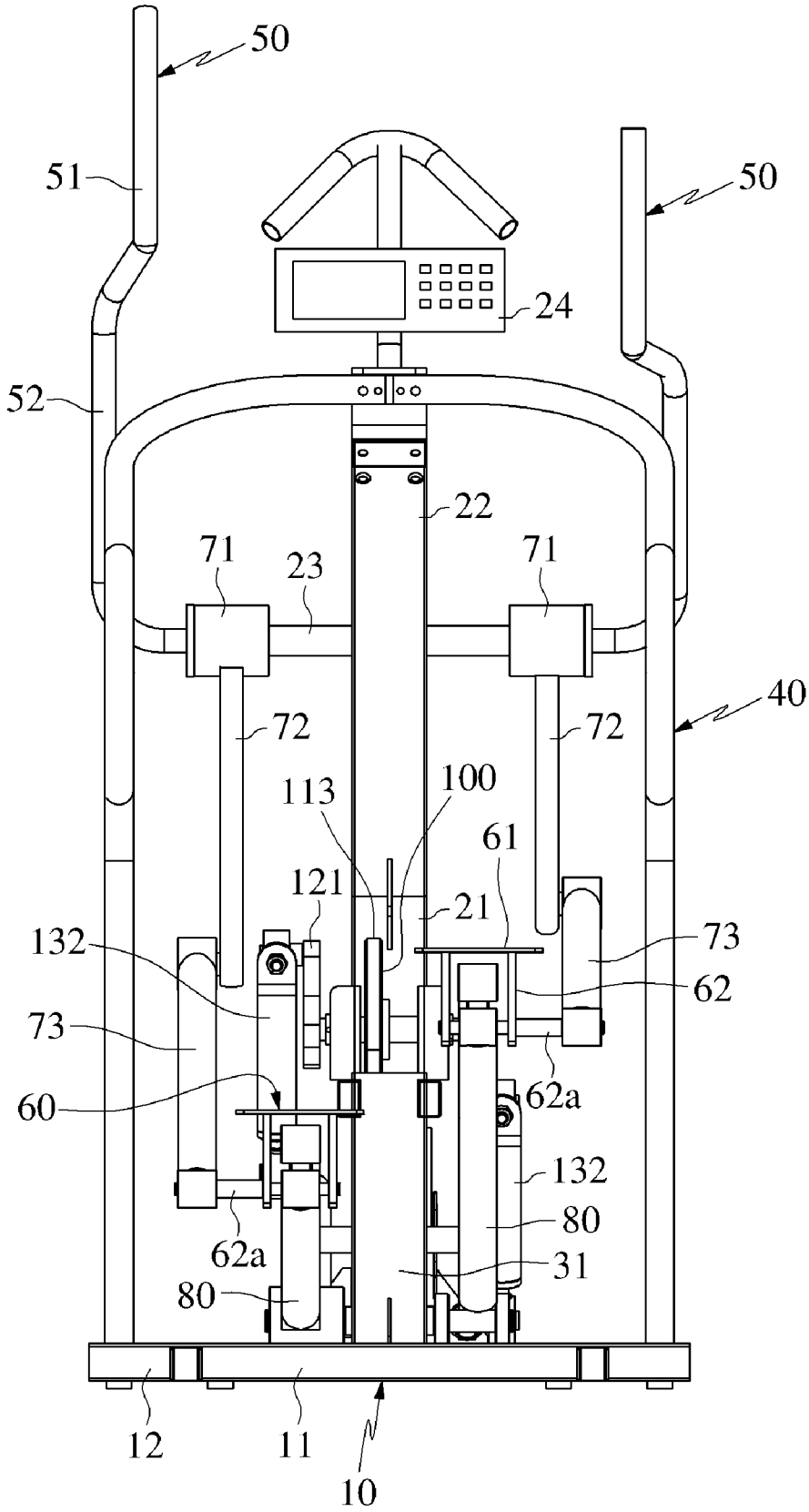
FIG. 4 is a rear view showing the pedal exercise machine according to the present invention.
Figure 5A:
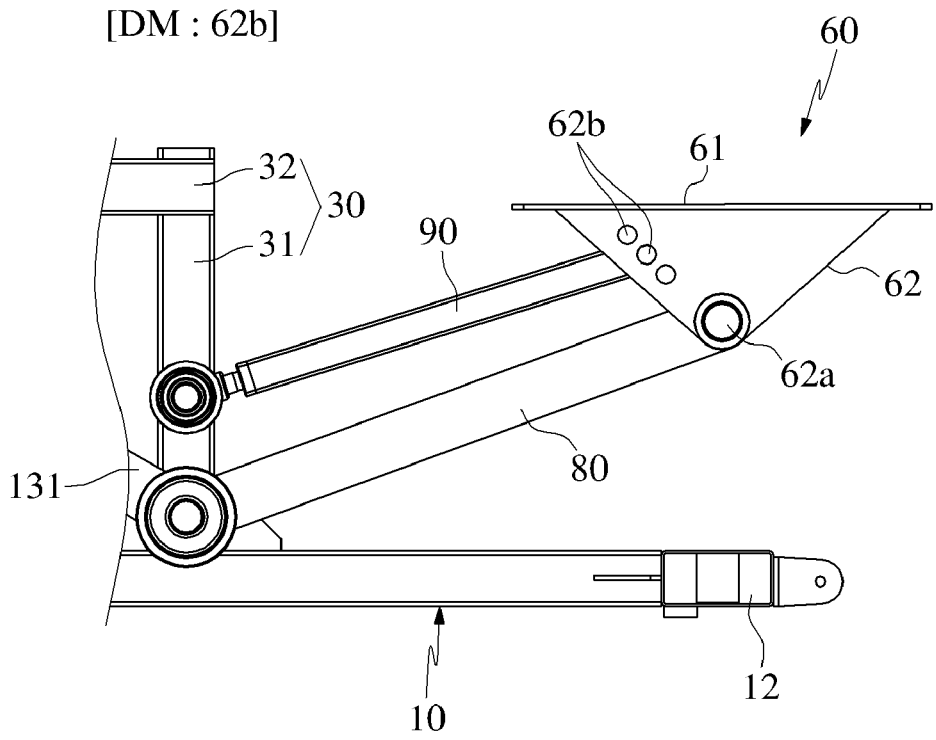
FIGS. 5A and 5B are views showing a displacement mechanism configured to adjust the angle of a pedal relative to the ground according to the present invention.
Figure 5B:
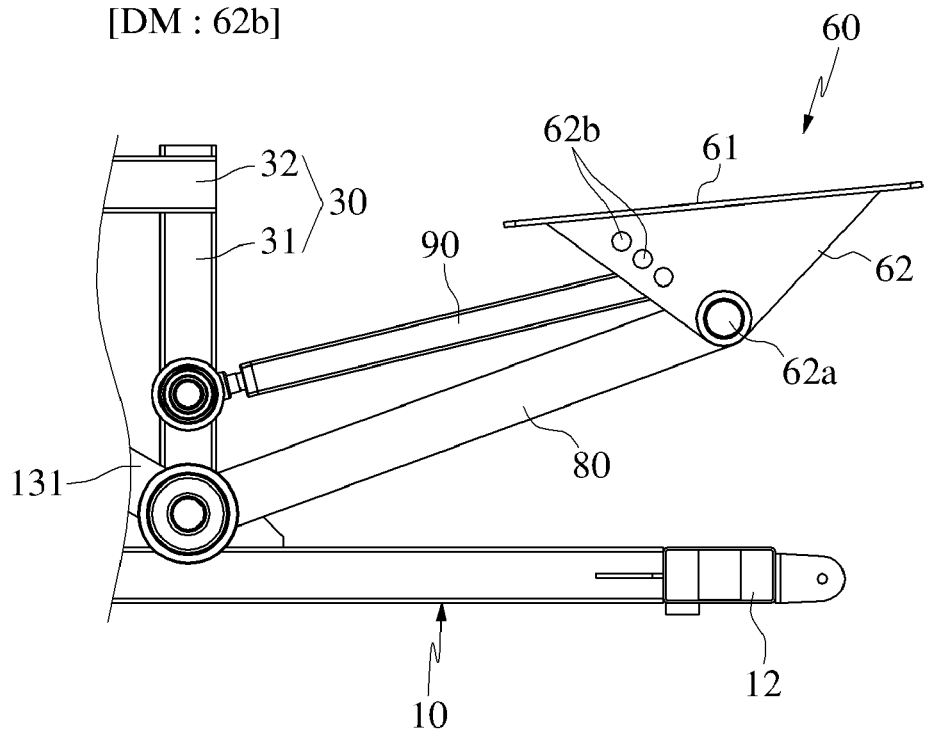
Figure 6:
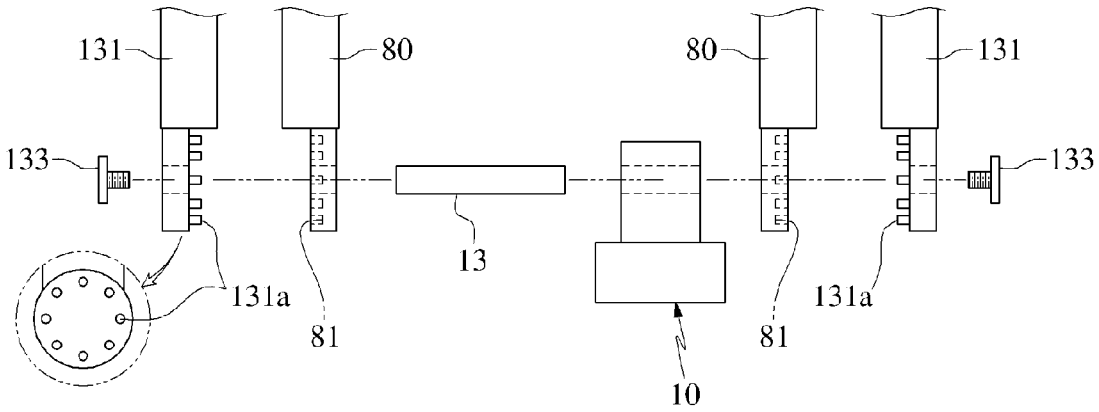
FIG. 6 is a view showing an angle adjustment mechanism of the pedal exercise machine according to the present invention.
Figure 7A:
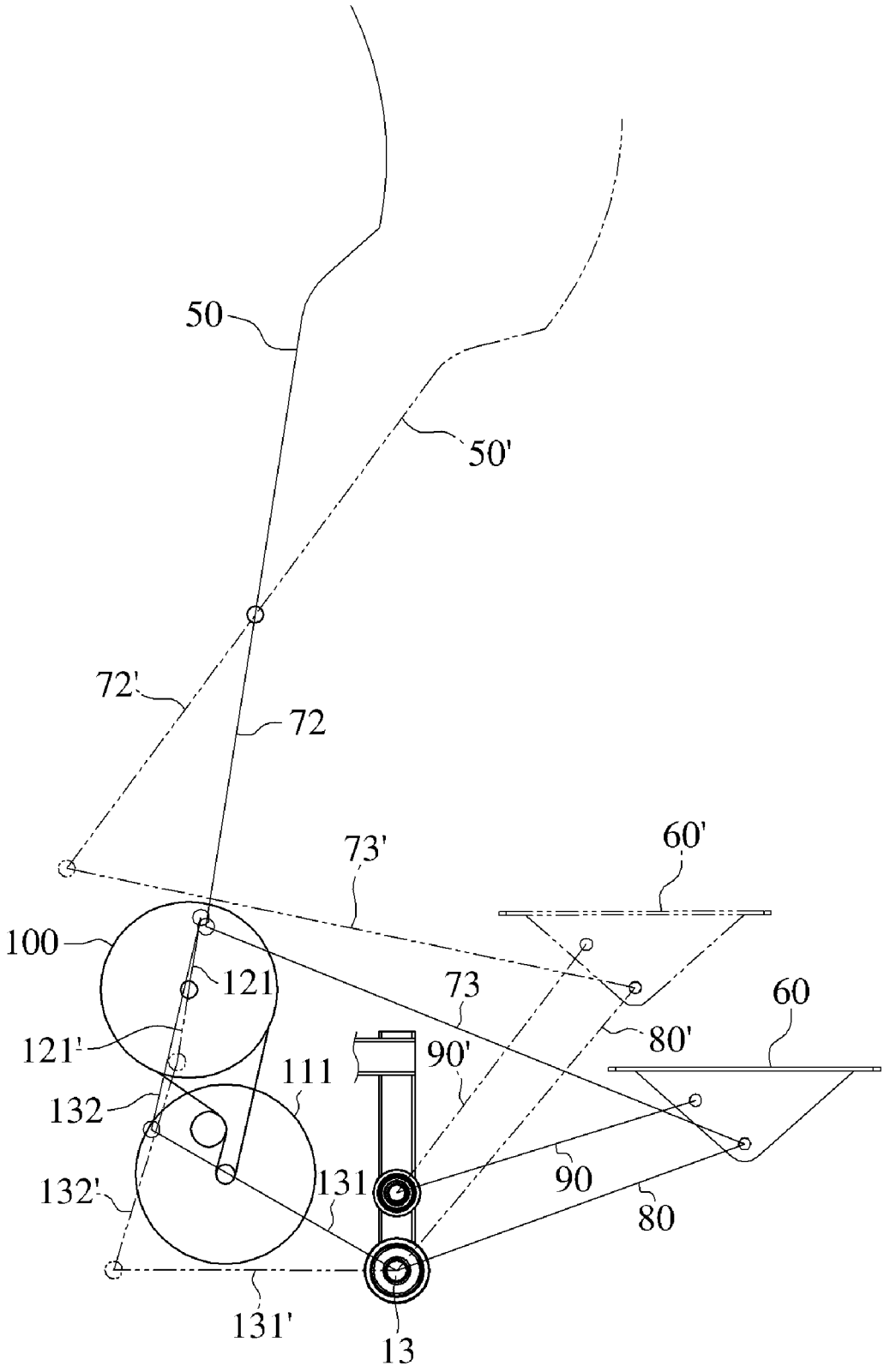
FIGS. 7A and 7B are schematic views showing the operation of the pedal exercise machine according to the present invention.
Figure 7B:
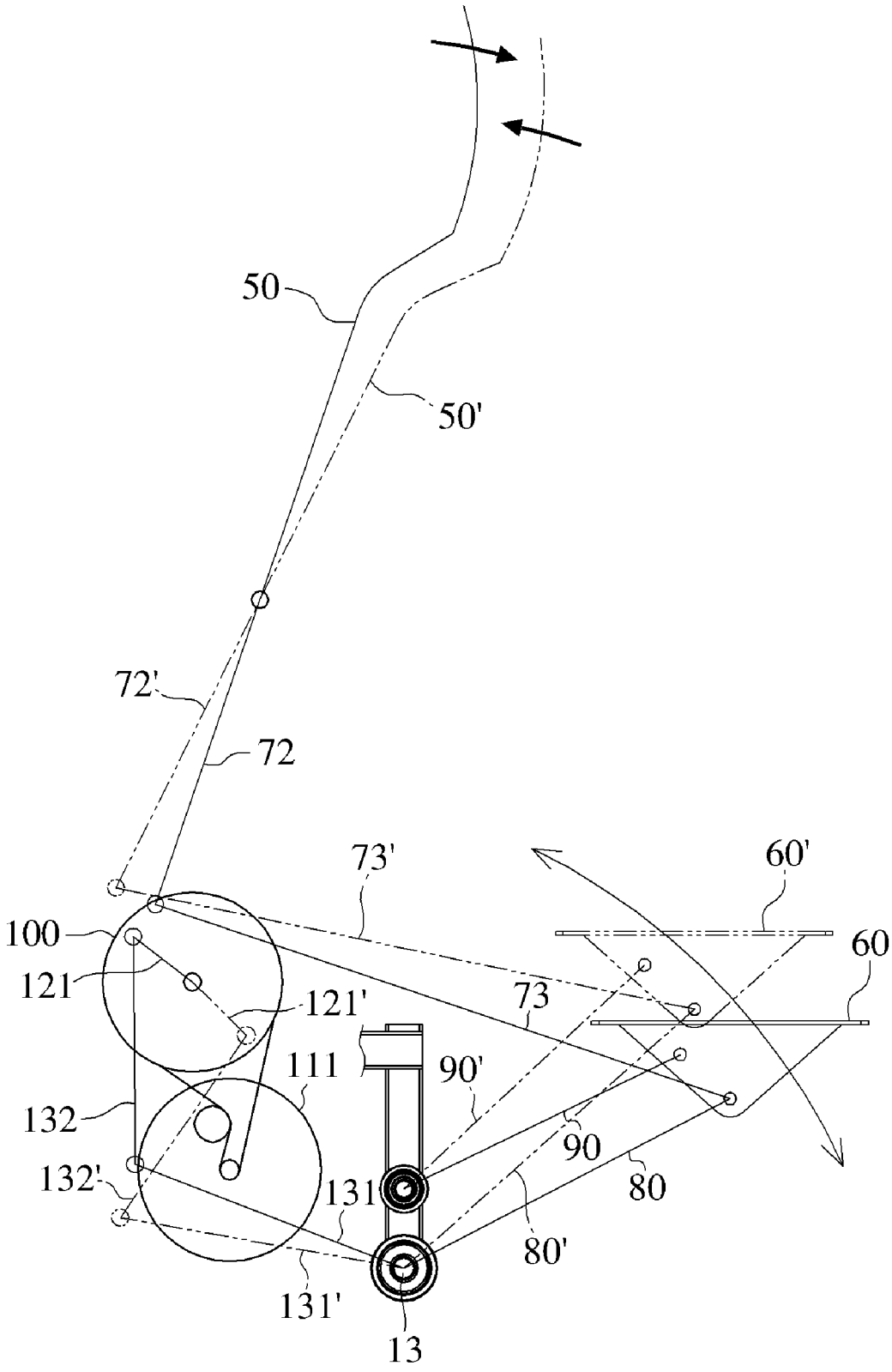
Figure 8A:
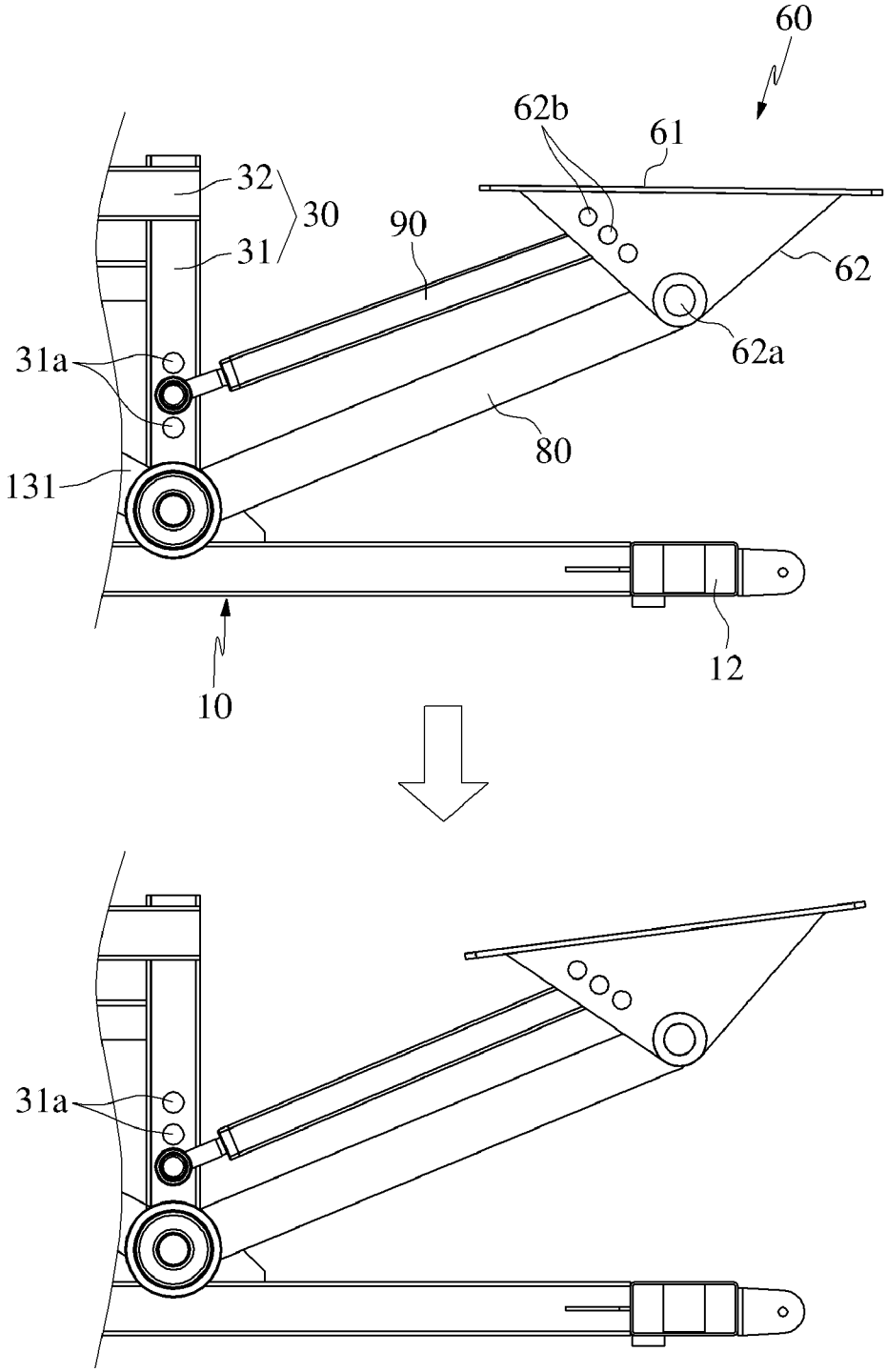
FIG. 8A is views illustrating a type of displacement mechanism in which the position of a link is changed.
Figure 8B:
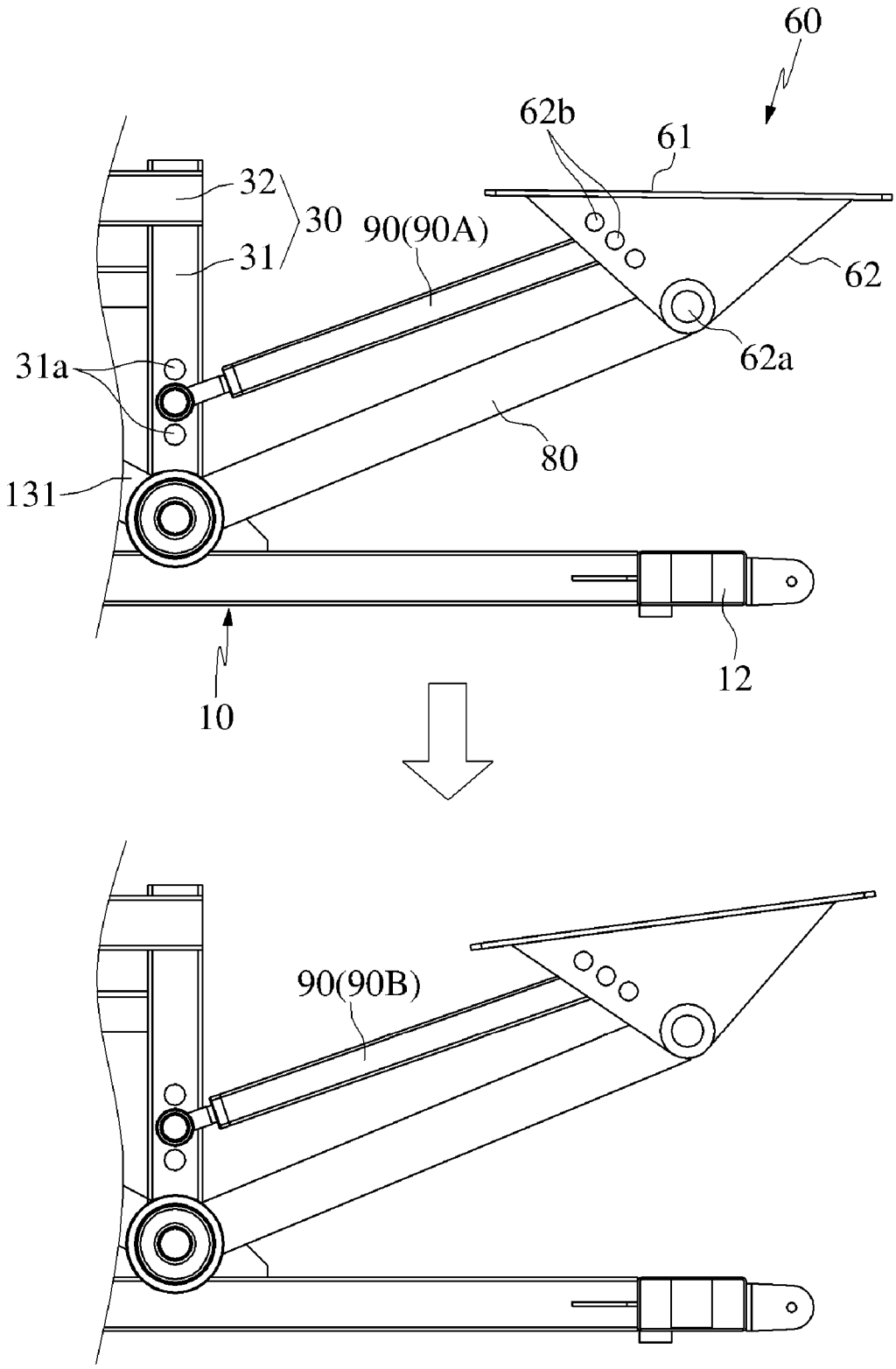
FIG. 8B is views illustrating a type of displacement mechanism in which the length of the link is adjusted.

FIG. 1 is a perspective view showing a pedal exercise machine having an arc trajectory, according to the preferred embodiment of the present invention. FIG. 2 is a side view showing the pedal exercise machine according to the present invention. FIG. 3 is a plan view showing the pedal exercise machine according to the present invention. FIG. 4 is a rear view showing the pedal exercise machine according to the present invention. FIGS. 5A and 5B are views showing a displacement mechanism configured to adjust the angle of a pedal relative to the ground according to the present invention. FIG. 6 is a view showing an angle adjustment mechanism of the pedal exercise machine according to the present invention. FIGS. 7A and 7B are schematic views showing the operation of the pedal exercise machine according to the present invention. FIG. 8A is views illustrating a type of displacement mechanism in which the position of a link is changed. FIG. 8B is views illustrating a type of displacement mechanism in which the length of the link is adjusted.

In the description of the present invention, FIGS. 7A and 7B illustrate two positions of elements depending on the operation of the pedal exercise machine. Here, the states of the elements at one of the two positions are designated by the solid lines, and the states of the elements at the other of the two positions are designated by the double-dot-dashed lines. Furthermore, the same reference numerals between the solid lines and the double-dot-dashed lines denote the same elements. For convenience of description, a separate mark (') is added at the end of each reference numeral, which indicates a corresponding double-dot-dashed line.

As shown in FIGS. 1 through 7, the pedal exercise machine according to the present invention includes a base 10, a front frame 20, a center frame 30, a rear frame 40, arm levers 50, pedals 60, lever link units 70, pedal links 80, subsidiary pedal links 90, a resistance pulley 100, a braking mechanism 110, a crank shaft 120 and crank link units 130.

1) Base 10

The base 10 has a predetermined length and is provided at respective opposite ends thereof with first and second support members 11 and 12. The base 10 has a shaft 13 in a medial portion thereof.

2) Front Frame 20

The front frame 20 includes a first frame 21, which is provided on the first support member 11 of the base 10 and has a predetermined height, and a second frame 22, which extends from the first frame 21 and is inclined at a predetermined angle. The front frame 20 further includes a control panel 24, which is provided on the second frame 22 to indicate various kinds of information and enable a user to control the operation of the pedal exercise machine.

Here, the control panel 24, the braking mechanism 110 and a power control unit 115, which will be explained later herein, are connected to each other through a wired or wireless communication method.

Furthermore, a sensor (not shown) for counting the number of steps of the pedals is provided in the resistance pulley 100 or the braking mechanism 110. The sensor serves to measure the number of repetitions of an exercise conducted by the user or the time for which the user exercises. The information obtained by the sensor is transmitted to the control panel 24.

3) Center Frame 30

The center frame 30 includes a vertical frame 31, which is coupled to the upper surface of the base 10, and a horizontal frame 32, which is coupled both to the vertical frame 31 and to the first frame 21 of the front frame 20.

4) Rear Frame 40

The rear frame 40 serves as a reinforcement and to ensure the safety of the user. In addition, the rear frame 40 serves to help the user step onto the pedals 60 and as a handle when the user exercises.

The rear frame 40 is coupled at a first end thereof to the second frame 22 of the front frame 20 and is coupled at a second end thereof to the second support member 12 of the base 10.

5) A Pair of Arm Levers 50

The arm levers 50 are operated in conjunction with the pedals 60 and are coupled to the front frame 20 so as to be rotatable in alternating directions with respect to the front frame 20.

Each arm lever 50 includes a handle 51 and a connection part 52. The connection part 52 extends from the handle 51 to a coupling member 71. The connection part 52 is rotatably coupled to the mounting shaft 23 of a second frame 22.

Therefore, depending on the vertical movement of the pedals 60, the arm levers 50 are operated in conjunction with the pedals 60. Furthermore, when the arm levers 50 are alternately moved forwards and backwards, the pedals 60 are operated in conjunction with the arm levers 50. At this time, the arm levers 50 and the pedals 60 are respectively moved along the trajectories B and A, similar to those of the arms and legs of a person when climbing a slope or stairs in an upright walking manner.

6) A Pair of Pedals 60

The pedals 60 are alternately moved upwards and downwards.

Each pedal 60 includes a footboard 61, and a pedal bracket 62, which is mounted to the lower surface of the footboard 61 and has a pedal shaft 62*a* in the center of the lower end thereof.

Here, an anti-slip mechanism (not shown) may be provided on the upper surface of each footboard 61.

As examples of the anti-slip mechanism, a plurality of protrusions may be provided on the upper surface of each footboard 61 in the shape of the sole of a foot of a person, or, alternatively, a depression having a shape corresponding to the sole of a foot of a person may be formed in the upper surface of each footboard 61.

7) A Pair of Lever Link Units 70

The lever link units 70 connects the arm levers 50 to the corresponding pedals 60.

Each lever link unit 70 includes a coupling member 71, which is rotatably fitted over the mounting shaft 23 and the corresponding arm lever 50, a first lever link 72, which is extended from the coupling member 71, and a second lever link 73, one end of which is coupled to the first lever link 72 and the other end of which is coupled to the pedal shaft 62*a* of the corresponding pedal 60.

8) A Pair of Pedal Links 80

The pedal links 80 connect the corresponding pedals 60 to the base 10. The pedal links 80 are rotatably coupled to corresponding pedals 60 by the identical shafts, through which the lever link units 70 are coupled to the pedals 60.

In detail, the pedal links 80 are rotatably coupled at first ends thereof to the pedal shaft 62*a* of the corresponding pedal brackets 62, and are rotatably coupled at second ends thereof to the shaft 13 of the base 10.

9) A Pair of Subsidiary Pedal Links 90

The subsidiary pedal links 90 are coupled between the center frame 30 and the corresponding pedals 60. The subsidiary pedal links 90 are coupled to the corresponding pedals 60 by shafts that are different from the shafts through which the pedal links 80 are coupled to the pedals 60.

In detail, the subsidiary pedal links 90 are rotatably coupled at first ends thereof to the vertical frame 31 of the center frame 30 and are rotatably coupled at second ends thereof to the pedal brackets 62 of the corresponding pedals 60 by shafts different from the shafts for the pedal links 80.

Furthermore, each subsidiary pedal link 90 has a displacement mechanism DM with respect to the pedals 60.

As the displacement mechanism DM, first displacement adjusting holes 62*b* are formed in each pedal bracket 62 at positions spaced apart from the pedal shaft 62*a*, and are arranged in a diagonal direction, and the second end of the subsidiary pedal link 90 is rotatably coupled to one of the first displacement adjusting holes 62*b*. Thus, as shown in FIGS. 5A and 5B, the angle C of the pedal 60 with respect to the ground can be adjusted.

The above-mentioned construction of the displacement mechanism DM is only one representative example, and various modifications or substitutions thereof are possible.

The displacement mechanism DM is constructed such that the angles of the pedals 60 relative to the ground vary depending on positions at which the subsidiary pedal links 90 are coupled to the vertical frame 31 of the center frame 30, the pedals 60 or both the center frame 30 and the pedals 60.

In addition, in the displacement mechanism DM, each subsidiary pedal link 90 may comprise two separate bodies (not shown), which are coupled to each other in an insert coupling manner such that the length of the subsidiary pedal link 90 is adjustable.

For example, referring to FIG. 8A, the displacement mechanism DM may further include second displacement adjusting holes 31*a*, which are formed in the vertical frame 31, and to one of which each subsidiary pedal link 90 is rotatably coupled, such that the positions of subsidiary pedal links 90 can be adjusted.

Furthermore, referring to FIG. 8B, the displacement mechanism DM may have a telescope type structure such that the length of each subsidiary pedal link 90 is adjustable (for example: one of a pair of link rods (bodies) is slidably inserted into a remaining one of the pair of link rods (bodies) so that the two link rods are fixed to each other using a screw or the like after the length thereof is adjusted).

Alternatively, the displacement mechanism DM may have a structure such that several subsidiary pedal links (90: 90A, 90B) having various lengths are prepared and a link having a desired length is selected and used.

Described above, the first displacement adjusting holes 62*b*, the second displacement adjusting holes 31*a*, the subsidiary pedal links 90, which are adjustable in length, or the set of several subsidiary pedal links (90: 90A, 90B) having various lengths may be independently used, or, alternatively, at least two kinds of mechanisms may be used together.

The displacement mechanism DM, which can have the above-mentioned various modifications or substitutions, makes it possible to adjust the angles of the pedals 60 with respect to the ground for the purpose of biomechanics or for the convenience of the user.

10) Resistance Pulley 100

The resistance pulley 100 is mounted to a mounting bracket 32*a*, which is provided on the horizontal frame 32 of the center frame 30.

The resistance pulley 100 enables to move the pedals 60, which are operated in conjunction with the corresponding arm levers 50, upwards and downwards in alternating directions.

11) Braking Mechanism 110

The braking mechanism 110 serves to brake the rotation of the resistance pulley 100, and includes a braking rotary member 111, which is provided on the upper surface of the base 10, a connection shaft 112, which is integrally provided in the center of the braking rotary member 111, and a connection belt 113, which transfers the rotating power of the resistance pulley 100 to the braking rotary member 111 through the connection shaft 112. The braking mechanism 110 further includes a braking operation member 114, which is provided adjacent to the circumferential outer surface of the braking rotary member 111 to electromagnetically or mechanically brake the braking rotary member 111 in response to a control signal transmitted from the control panel 24, and a power control unit 115, which supplies power having a predetermined intensity to operate the braking operation member 114.

A control signal is transmitted from the control panel 24 to the power control unit 115. Thereafter, the control signal is transmitted to the braking operation member 114 and the braking rotary member 111, so that the user who pedals the pedals 60 can adjust exercise intensity. That is, the exercise intensity is determined by the control of the power control unit 115 which enables the braking operation member 114 to hold or release the braking rotary member 111 mechanically or electromechanically by providing electric or mechanical energy to the braking operation member 114. To prevent rapid starting or rapid braking, it is preferable that the power control unit 115 control the braking operation member 114 such that it slowly compresses or decompresses the braking rotary member 111.

12) Crank Shaft 120

The crank shaft 120 is coupled to the resistance pulley 100 and is provided with the crank arms 121, each of which has a length adjustment mechanism LM.

The crank shaft 120 is fitted into the center of the resistance pulley 100 and coupled to the crank arms 121, which are coupled to second crank links 132 of the corresponding crank link units 130.

Meanwhile, in the length adjustment mechanism LM, several shaft holes 121*a* are formed in the one end of each crank arm 121, and are arranged in the longitudinal direction of the crank arm 121. Depending on which shaft hole 121*a* the crank shaft 120 is fitted into, the distance between the crank shaft 120 and the second crank link 132 of the corresponding crank link unit 130 is adjusted. Therefore, as shown in FIG. 2, the lengths of the trajectories A and B of the pedals 60 and the arm levers 50 can be adjusted. In other words, depending on the height of the user or the length of the arms of the user, the length of the exercise trajectory can be adjusted by increasing or reducing the lengths of the crank arms 121 between the crank shaft 120 and the second crank links 132 of the crank link units 130.

Here, the above-mentioned construction of the length adjustment mechanism LM is only one representative example, and various modifications or substitutions thereof are possible.

13) A Pair of Crank Link Units 130

The crank link units 130 connect the respective pedal links 80 to the corresponding crank arms 121 of the crank shaft 120, and include an angle adjustment mechanism AM for adjusting angles between the crank line units 130 and the pedal links 80 around the shaft 13, through which the pedal links 80 are coupled to the base 10.

Each crank link unit 130 includes a first crank link 131, which is coupled to the corresponding pedal link 80 at a predetermined angle, and the second link 132, which is coupled at the opposite ends thereof to the first link 131 and the corresponding crank arm 121.

Meanwhile, in the angle adjustment mechanism AM, a first end of a first crank link 131 of each crank link unit 130 is coupled to the corresponding pedal link 80 through the single shaft 13.

The angle adjustment mechanism AM includes a plurality of coupling protrusions 131*a*, which are provided on the first end of the first crank link 131 of each crank link unit 130 and are arranged around the center of the first end of the first crank link 131 in the circumferential direction, and a plurality of coupling holes 81, which are formed in the second end of each pedal link 80, and into which the respective coupling protrusions 131*a* of the first crank link 131 are inserted. The angle adjustment mechanism AM further includes a coupling mechanism 133, which is coupled to the shaft 13 of the base 10, which is disposed at the center among the coupling protrusions 131*a* inserted into the respective coupling holes 81.

Here, preferably, a bearing (not shown) is interposed between the shaft 13 of the base 10 and each pedal link 80 to prevent noise attributable to friction and ensure smooth rotation.

Due to this construction, the angle between each pedal link 80 and the corresponding first crank link 131 of the crank link unit 130 can be adjusted by changing the position at which the coupling protrusions 131*a* of the first crank link 131 are inserted into the respective coupling holes 81 of the pedal link 80, after the coupling mechanism 133 is loosened.

Thereby, as shown in FIGS. 2 and 6, the position of the trajectory A of the pedals 60 can be adjusted. As a result, various exercise effects according to the position adjustment can be obtained.

In the angle adjustment mechanism AM, the ultimate purpose of the adjustment in the angle between the pedal links 80 and the first crank links 131 of the crank link unit 130 is to move the position of the trajectory of the pedals 60.

For example, when the angular range of the trajectory of the pedals 60 is 40°, the trajectory of the pedals 60 may be within a range from 0° to 40° relative to the ground, or, alternatively, may be within a range from 30° to 70° relative to the ground. As a further alternative, the trajectory of the pedals 60 may be within a range from 50° to 90° relative to the ground.

Depending on the position of the trajectory of the pedals 60, the posture of the user when exercising and the used muscles vary, thus obtaining different exercising effects.

Furthermore, the above-mentioned construction of the angle adjustment mechanism AM is only one representative example, and various modifications or substitutions thereof are possible.

As described above, a pedal exercise machine having an arc trajectory according to the present invention provides a pedal trajectory similar to the trajectory of the feet of a person when climbing a slope or stairs. Furthermore, the pedal exercise machine of the present invention includes arm levers, which are operated in conjunction with pedals, thus enabling a user to conduct upper body exercise and lower body exercise at the same time, in other words, to exercise all parts of the body.

In addition, in the present invention, stationary handles are provided at various positions, so that the degree of freedom of the posture of the user is increased, thus providing an effect similar to, for example, climbing a slope or riding a bicycle in a standing position.

As well, depending on the adjustment of the exercise load, a desired effect, for example, of strengthening cardiopulmonary endurance, reducing body fat, or of strengthening muscular power, can be obtained. In other words, when the exercise load is relatively low, the effect of an aerobic exercise machine can be obtained. When the exercise load is relatively high, an effect of an exercise for strengthening muscular power can be obtained.

Moreover, using a displacement mechanism, an angle adjustment mechanism and a length adjustment mechanism, the present invention enables the user to change the parts of the body to be exercised, thus providing various exercise effects.

That is, to provide various exercise effects, the present invention includes the displacement mechanism and the length adjustment mechanism configured to adjust the angle of the pedals relative to the ground, the length adjustment mechanism for increasing or reducing the length of the trajectories of the pedals and the lever arms in consideration of the height of the user and the length of the arms of the user, and the angle adjustment mechanism configured to adjust the position of the trajectory of the pedals. Thereby, the pedal exercise machine having the arc trajectory according to the above-mentioned objects of the present invention can be realized.

Although the pedal exercise machine according to the preferred embodiment, having a special shape and construction, has been disclosed for illustrative purposes with reference to the attached drawings, those skilled in the art will appreciate that various modifications, additions and substitutions are possible. Furthermore, such modifications, additions and substitutions must be interpreted as falling within the scope and spirit of the invention as disclosed in the accompanying claims.

What is claimed is:

1. A pedal exercise machine having an arc trajectory, comprising:

a base;

a front frame and a center frame provided on the base, the front frame and the center frame being coupled to each other;

a pair of pedals to move upwards and downwards in alternating directions;

a pedal link for connecting each of the pedals to the base;

a subsidiary pedal link for connecting each of the pedals to the center frame, the subsidiary pedal link being coupled to the pedal by a first shaft different from a second shaft, through which the corresponding pedal link is coupled to the corresponding pedal;

a resistance pulley provided in the center frame;

a crank shaft coupled to the resistance pulley, the crank shaft being provided with crank arms, each of which has a length adjustment mechanism; and a crank link unit for connecting each of the pedal links to the corresponding crank arm of the crank shaft, the crank link unit having an angle adjustment mechanism configured to adjust an angle between the corresponding pedal link and the corresponding crank link unit around a base-side shaft of the pedal link; wherein the crank link unit comprises:

a first crank link coupled to the corresponding pedal link at a predetermined angle; and a second crank link coupled at respective opposite ends thereof to the first crank link and the corresponding crank arm; and whereby adjusting an angle between the corresponding pedal link and the corresponding crank link unit adjusts a trajectory of one of the pedals.

2. The pedal exercise machine as set forth in claim 1, further comprising:

a pair of arm levers coupled to the front frame, the arm levers being rotatable with respect to the front frame in alternating directions; and a lever link unit for connecting each of the arm levers to the corresponding pedal, the lever link unit being coupled to the pedal by the second shaft that couples the corresponding pedal link to the corresponding pedal.

3. The pedal exercise machine as set forth in claim 2, wherein the lever link unit comprises:

a first lever link coupled to the corresponding arm lever; and a second lever link coupled at respective opposite ends thereof to the first lever link and the corresponding pedal.

4. A pedal exercise machine having an arc trajectory, comprising:

a base;

a front frame and a center frame provided on the base, the front frame and the center frame being coupled to each other;

a pair of pedals to move upwards and downwards in alternating directions;

a pedal link for connecting each of the pedals to the base;

a subsidiary pedal link for connecting each of the pedals to the center frame, the subsidiary pedal link being coupled to the pedal by a first shaft different from a second shaft through which the corresponding pedal link is coupled to the corresponding pedal, the subsidiary pedal link having a displacement mechanism configured to displace relative to the corresponding pedal;

a resistance pulley provided in the center frame;

a crank shaft coupled to the resistance pulley, the crank shaft being provided with a crank arm;

a crank link unit for connecting each of the pedal links to the corresponding crank arm of the crank shaft, the crank link unit being coupled to the corresponding pedal link around a base-side shaft of the pedal link at a predetermined angle;

a pair of arm levers coupled to the front frame, the arm levers being rotatable with respect to the front frame in alternating directions; and a lever link unit for connecting each of the arm levers to the corresponding pedal, the lever link unit being coupled directly to the pedal by the second shaft that couples the corresponding pedal link to the corresponding pedal.

5. The pedal exercise machine as set forth in claim 4, wherein the crank link unit comprises:

a first crank link coupled to the corresponding pedal link at a predetermined angle; and a second crank link coupled at respective opposite ends thereof to the first crank link and the corresponding crank arm.

6. The pedal exercise machine as set forth in claim 4, wherein the lever link unit comprises:

a first lever link coupled to the corresponding arm lever; and a second lever link coupled at respective opposite ends thereof to the first lever link and the corresponding pedal.

7. The pedal exercise machine as set forth in claim 4, wherein the displacement mechanism is constructed such that the subsidiary pedal link comprises two separate bodies coupled to each other so as to be adjustable in length.

8. The pedal exercise machine as set forth in claim 4, wherein the displacement mechanism is constructed such that angles of the pedals relative to a ground vary depending on positions, at which the subsidiary pedal links are coupled to the center frame, the pedals, or both the center frame and the pedals.

9. The pedal exercise machine as set forth in claim 8, wherein the displacement mechanism is constructed such that the subsidiary pedal link comprises two separate bodies coupled to each other so as to be adjustable in length.

10. A pedal exercise machine having an arc trajectory, comprising:

a base;

a front frame and a center frame provided on the base, the front frame and the center frame being coupled to each other;

a pair of pedals to move upwards and downwards in alternating directions;

a pedal link for connecting each of the pedals to the base;

a subsidiary pedal link for connecting each of the pedals to the center frame, the subsidiary pedal link being coupled to the pedal by a first shaft different from a second shaft through which the corresponding pedal link is coupled to the corresponding pedal, the subsidiary pedal link having a displacement mechanism configured to displace relative to the corresponding pedal;

a resistance pulley provided in the center frame;

a crank shaft coupled to the resistance pulley, the crank shaft being provided with a crank arm;

a crank link unit for connecting each of the pedal links to the corresponding crank arm of the crank shaft, the crank link unit being coupled to the corresponding pedal link around a base-side shaft of the pedal link at a predetermined angle;

wherein the displacement mechanism is constructed such that the subsidiary pedal link comprises two separate bodies coupled to each other so as to be adjustable in length; and wherein the center frame includes adjusting holes for adjusting the position of the subsidiary pedal links along the center frame.

* * * * *